US008912714B2

(12) United States Patent
Ban et al.

(10) Patent No.: US 8,912,714 B2
(45) Date of Patent: Dec. 16, 2014

(54) SPARK PLUG

(75) Inventors: Kenji Ban, Gifu (JP); Akira Suzuki, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 14/001,197

(22) PCT Filed: Feb. 2, 2012

(86) PCT No.: PCT/JP2012/000703

§ 371 (c)(1),
(2), (4) Date: Aug. 23, 2013

(87) PCT Pub. No.: WO2012/114661

PCT Pub. Date: Aug. 30, 2012

(65) Prior Publication Data

US 2013/0328476 A1 Dec. 12, 2013

(30) Foreign Application Priority Data

Feb. 25, 2011 (JP) ..... 2011-039125

(51) Int. Cl.
*H01T 13/20* (2006.01)
*H01T 13/32* (2006.01)

(52) U.S. Cl.
CPC ..... *H01T 13/32* (2013.01)
USPC ..... 313/141

(58) Field of Classification Search
CPC ..... H01T 13/32; H01T 13/20
USPC ..... 313/118–145
See application file for complete search history.

(56) References Cited

U.S. PATENT DOCUMENTS

| | | | | |
|---|---|---|---|---|
| 7,259,506 | B1 * | 8/2007 | Maxwell | 313/141 |
| 2003/0085643 | A1 | 5/2003 | Matsubara | 313/141 |
| 2007/0080618 | A1 * | 4/2007 | Torii et al. | 313/143 |
| 2007/0188065 | A1 * | 8/2007 | Ishinada et al. | 313/141 |
| 2008/0122334 | A1 * | 5/2008 | Kishimoto et al. | 313/141 |
| 2009/0066211 | A1 * | 3/2009 | Hartmann et al. | 313/141 |
| 2009/0289540 | A1 * | 11/2009 | Nunome et al. | 313/141 |
| 2010/0264803 | A1 | 10/2010 | Nunome et al. | 313/141 |

FOREIGN PATENT DOCUMENTS

| | | | |
|---|---|---|---|
| JP | 51-81835 | 6/1976 | |
| JP | 09-129356 | 5/1997 | H01T 13/20 |
| JP | 2001-237046 | 8/2001 | H01T 13/46 |
| JP | 2003-17215 | 1/2003 | H01T 13/20 |
| JP | 2007-134319 | 5/2007 | H01T 13/32 |
| JP | 2007-242588 | 9/2007 | H01T 13/32 |
| WO | WO 2009/066714 | 5/2009 | H01T 21/02 |

OTHER PUBLICATIONS

Form PCT/ISA/210—Int'l Search Report (from corresponding Int'l Patent App. No. PCT/JP2012/000703—2 pages (English version only).

* cited by examiner

*Primary Examiner* — Donald Raleigh
(74) *Attorney, Agent, or Firm* — Kusner & Jaffe

(57) ABSTRACT

A spark plug including: a center electrode which extends in an axial direction; a cylindrical insulator which is disposed around an outer circumference of the center electrode; a cylindrical metal shell which is disposed around an outer circumference of the insulator; and a ground electrode having one end connected to the metal shell, and an end surface of the other end being positioned between the one end and the center electrode or on the center electrode, when viewed in the axial direction of the center electrode, wherein the end surface has a maximum width portion which is formed only at a position where a distance from a center position of the end surface is 12% to 88% of a distance from the center position to an outer side surface of the ground electrode.

6 Claims, 11 Drawing Sheets

| FIRST GROUP | SAMPLE #1 | SAMPLE #2 | SAMPLE #3 | SAMPLE #4 | SAMPLE #5 |
|---|---|---|---|---|---|
| SECOND GROUP | SAMPLE #6 | SAMPLE #7 | SAMPLE #8 | SAMPLE #9 | SAMPLE #10 |
| SHAPE |   NO TIP |   TIP IS EMBEDDED |   TIP DOWNWARD PROJECTS |   LEADING END OF TIP PROJECTS |   TIP DOWNWARD PROJECTS AND LEADING END PROJECTS |

SPARK PLUG

FIELD OF THE INVENTION

The present invention relates to a spark plug.

BACKGROUND OF THE INVENTION

From an environmental viewpoint, recently, the development of a high-compression and highly supercharged engine is actively performed, and a spark plug having an ignitability which is stable in a high-pressure environment is requested. Moreover, a technique has been known in which, in order to improve the ignitability, the sectional shape of a leading end portion of a ground electrode is made trapezoidal (See Japanese Document No. JP-A-H09-129356; See also Japanese Document No. JP-A-2007-242588).

In the conventional art, in the case where a spark plug is used in a high-pressure environment, however, there arises, for example, a problem in that the temperature of a leading end portion of a ground electrode is raised. Accordingly, in the technique for improving the ignitability of a spark plug which is used in a high-pressure environment, there remains room for improvement.

The invention has been conducted in order to solve the above-discussed problem. It is an object of the invention to improve the ignitability of a spark plug which is used in a high-pressure environment.

SUMMARY OF THE INVENTION

In order to solve at least part of the above-discussed problem, the invention can be realized as the following modes or application examples.

APPLICATION EXAMPLE 1

In accordance with a first embodiment of the present invention, there is provided a spark plug including:

a center electrode which extends in an axial direction;

a cylindrical insulator which is disposed around an outer circumference of the center electrode;

a cylindrical metal shell which is disposed around an outer circumference of the insulator; and a ground electrode having one end connected to the metal shell and which is curved from the one end to another end thereof, and an end surface of the other end being positioned between the one end and the center electrode or on the center electrode, when viewed in the axial direction of the center electrode, wherein the end surface has a maximum width portion which has a maximum width in a direction perpendicular to the axial direction of the center electrode and is formed only at a position which is 12% to 88% from a center position of the end surface toward an outer side surface of the ground electrode in a direction directed from an inner side surface of the ground electrode to the outer side surface of the ground electrode, and, wherein the more away from the maximum width portion toward the inner side surface and the outer side surface of the ground electrode, respectively, the more reduced the width of the end surface is in the direction perpendicular to the axial direction of the center electrode.

According to the configuration, the length of the ground electrode is shortened. Therefore, even in a high-pressure environment, the temperature rise of a leading end portion of the ground electrode can be suppressed, and the flow of the air-fuel mixture can be rectified. Consequently, the ignitability of the ground electrode can be improved.

APPLICATION EXAMPLE 2

In accordance with a second embodiment of the present invention, there is provided a spark plug according to the application example 1, wherein the end surface has the maximum width portion which is formed only at a position which is 25% to 75% from the center position of the end surface toward the outer side surface in the direction directed from the inner side surface of the ground electrode to the outer side surface of the ground electrode.

According to the configuration, the maximum width portion of the end surface is formed only at the position which is 25% to 75% from the center position of the end surface toward the outer side surface of the ground electrode. Therefore, the flow of the air-fuel mixture can be rectified, and the ignitability of the ground electrode can be further improved.

APPLICATION EXAMPLE 3

In accordance with a third embodiment of the present invention, there is provided a spark plug according to the application example 1 or 2, wherein an outer peripheral portion of the end surface includes a first end edge and a second end edge which linearly extend in the direction perpendicular to the axial direction of the center electrode, wherein the first end edge is a line of intersection of the end surface and the outer side surface, wherein the second end edge is a line of intersection of the end surface and the inner side surface, and wherein a length A1 of the first end edge is longer than a length A2 of the second end edge and shorter than the width of the maximum width portion.

According to the configuration, in the end surface, the length A1 of the end edge of the outer side surface side is longer than the length A2 of the end edge of the inner side surface side and shorter than the width of the maximum width portion. Therefore, the flow of the air-fuel mixture can be rectified, and the ignitability of the ground electrode can be improved.

APPLICATION EXAMPLE 4

In accordance with a fourth embodiment of the present invention, there is provided a spark plug according to the application example 3, wherein, in the end surface, the outer peripheral portion between the first end edge and the second edge has a curved shape.

According to the configuration, in the outer peripheral portion of the end surface, the portion by which the first end edge and the second end edge are connected to each other has a curved shape. Therefore, the flow of the air-fuel mixture can be rectified, and the ignitability of the ground electrode can be improved.

APPLICATION EXAMPLE 5

In accordance with a fifth embodiment of the present invention, there is provided a spark plug according to any one of the application examples 1 to 4, wherein the width of the maximum width portion is equal to or larger than 1.5 mm and equal to smaller than 2.2 mm.

According to the configuration, the width of the maximum width portion can be made from 1.5 mm to 2.2 mm. Therefore, the ignitability of the ground electrode can be improved.

APPLICATION EXAMPLE 6

In accordance with a sixth embodiment of the present invention, there is provided a spark plug according to any one of the application examples 1 to 5, wherein the ground electrode is attached so that a noble metal tip projects from the end surface.

According to the configuration, the rectified air-fuel mixture gas can be guided to the ignition point while flowing along the noble metal tip. Therefore, the ignitability of the ground electrode can be improved.

BRIEF DESCRIPTION OF THE DRAWINGS

FIG. 2(*b*) is an enlarged, side view of the vicinity of a leading end portion 22 of a center electrode 20 of the spark plug 100.

DETAILED DESCRIPTION OF PREFERRED EMBODIMENTS

A. First Embodiment

Figure 1:
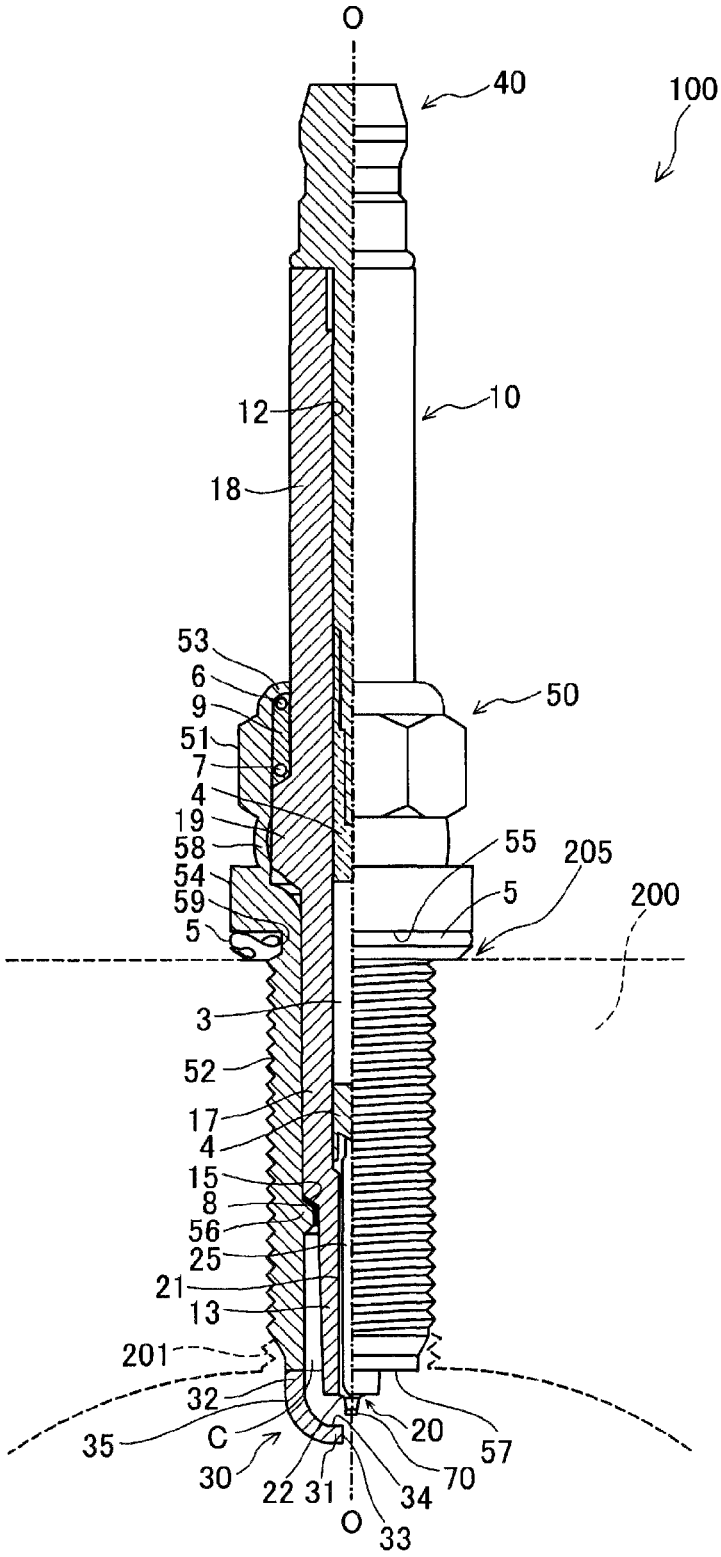
FIG. 1 is a partially sectional view of a spark plug 100 of a first embodiment.

FIG. 1 is a partially sectional view of a spark plug 100 of a first embodiment. In FIG. 1, the direction of an axis O of the spark plug 100 is the vertical direction of the drawing, the lower side is the leading end side of the spark plug 100, and the upper side is the rear end side.

The spark plug 100 includes: an insulator 10 functioning as an insulating body; a metal shell 50 holding the insulator 10; a center electrode 20 which is held in the insulator 10 in the direction of the axis O; a ground electrode 30 in which a base end portion 32 is welded to the leading end surface 57 of the metal shell 50, and the range from the base end portion 32 to a leading end portion 31 is curved toward a leading end portion 22 of the center electrode 20; and a terminal metal fixture 40 which is disposed at a rear end portion of the insulator 10.

The insulator 10 is formed by firing of alumina or the like as known in the art, and has a tubular shape in which an axial hole 12 extending in the direction of the axis O is formed in the axial center. A flange portion 19 having the largest outer diameter is formed at a substantially middle position in the direction of the axis O, and a rear end trunk portion 18 is formed at the rear end side (the upper side in FIG. 1) with respect to the flange portion 19. At the leading end side (the lower side in FIG. 1) with respect to the flange portion 19, a leading end trunk portion 17 having an outer diameter which is smaller than that of the rear end trunk portion 18 is formed, and at the leading end side with respect to the leading end trunk portion 17, an insulator nose portion 13 having an outer diameter which is smaller than that of the leading end trunk portion 17 is formed. The more away toward the leading end side, the more reduced the outer diameter of the insulator nose portion 13 is, and when the spark plug 100 is attached to an engine head 200 of an internal combustion engine, the insulator nose portion is exposed to a combustion chamber of the engine. A step 15 is formed between the insulator nose portion 13 and the leading end trunk portion 17.

The center electrode 20 is a rod-like electrode having a structure in which a core member 25 is embedded in an electrode base member 21 formed by nickel or a nickel-based alloy such as Inconel (trademark) 600 or 601. The core member 25 is made of copper or copper-based alloy which is superior in thermal conductivity than the electrode base member 21. Usually, the center electrode 20 is produced by filling the core member 25 into the electrode base member 21 which is formed in a bottomed cylindrical shape, and performing an extrusion molding process starting from the bottom side to extend the shape. The core member 25 has a substantially constant outer diameter at the trunk portion, but is formed in a shape that a diameter of the core member 25 is reduced towards the leading end side.

The leading end portion 22 of the center electrode 20 projects from the leading end portion of the insulator 10, and is formed so as to be further reduced in diameter toward the leading end. In order to improve the spark consumption resistance, a center electrode tip 70 which is made of a high melting noble metal, and which has a substantially cylindrical shape is joined to the leading end surface of the leading end portion 22 of the center electrode 20. For example, the center electrode tip 70 may be formed by iridium (Ir) or an Ir alloy which essentially consists of Ir, and to which one or two or more of platinum (Pt), rhodium (Rh), ruthenium (Ru), palladium (Pd), and rhenium (Re) are added.

The center electrode 20 and the center electrode tip 70 are joined such that laser welding is performed on the outer circumference of the joining surface between the center electrode tip 70 and the leading end portion 22 of the center electrode 20. As a result of the laser welding, the materials are melted and mixed by laser irradiation, and therefore the center electrode tip 70 and the center electrode 20 are firmly joined to each other. The center electrode 20 extends through the axial hole 12 toward the rear end side, and is electrically connected to the terminal metal fixture 40 in the rear side (the upper side in FIG. 1) through a seal member 4 and a ceramic resistor 3 (see FIG. 1). A high-voltage cable (not shown) is connected to the terminal metal fixture 40 through a plug cap (not shown), and a high voltage is applied to the cable.

The metal shell 50 is a cylindrical metal member for fixing the spark plug 100 to the engine head 200 of the internal combustion engine. The metal shell 50 holds the insulator 10 therein so as to surround a region of the insulator extending from a part of the rear end trunk portion 18 to the insulator nose portion 13. The metal shell 50 is formed from a low-carbon steel, and includes a tool engagement portion 51 to which an unillustrated spark plug wrench is to be fitted, and in which an attachment screw portion 52 on which threads for thread engagement with an attachment threaded hole 201 of the engine head 200 disposed in an upper portion of the internal combustion engine are formed.

In the metal shell 50, a flange-like seal portion 54 is formed between the tool engagement portion 51 and the attachment portion 52. An annular gasket 5 which is formed by bending a sheet body is fittingly inserted onto a thread neck 59 between the attachment screw portion 52 and the seal portion 54. When the spark plug 100 is mounted on the engine head 200, the gasket 5 is crushed and deformed between a seating surface 55 of the seal portion 54 and an opening peripheral edge portion 205 of the attachment threaded hole 201. The deformation of the gasket 5 causes the gap between the spark plug 100 and the engine head 200 to be sealed, thereby preventing air leakage from the engine through the attachment threaded hole 201 from occurring.

The ground electrode 30 is configured by a metal having high corrosion resistance. For example, a nickel alloy such as Inconel (trademark) 600 or 601 is used. The spark plug 100 is characterized in the shape of the ground electrode 30. The shape of the ground electrode 30 will be described later in detail with reference to FIGS. 2 to 4.

To the metal shell 50, a thin crimping portion 53 is disposed at the rear end side with respect to the tool engagement portion 51. A buckling portion 58 which is thin similarly with the crimping portion 53 is disposed between the seal portion 54 and the tool engagement portion 51. In a range from the tool engagement portion 51 to the crimping portion 53, annular cylindrical members 6, 7 are interposed between the inner circumferential surface of the metal shell 50 and the rear end trunk portion 18 of the insulator 10, and the space between the cylindrical members 6, 7 is filled with a powder of talc 9. By forming the crimping portion 53 through inwardly bending portion of the metal shell 50, the insulator 10 is pressed toward the leading end side in the metal shell 50 through the cylindrical members 6, 7 and the talc 9. Therefore, the step 15 of the insulator 10 is supported through an annular sheet packing 8 by a step 56 which is formed in the inner circumference of the metal shell 50, and at the position of the attachment screw portion 52, thereby integrating the metal shell 50 with the insulator 10. At this time, airtightness between the metal shell 50 and the insulator 10 is maintained by means of the sheet packing 8, thereby preventing a combustion gas from outflowing. The buckling portion 58 is configured so as to be outward flexurally deformed in association with application of a compressive force in a crimping process, thereby increasing the stroke of compression of the talc 9 so that airtightness of the interior of the metal shell 50 is enhanced. On the side of the leading end side with respect to the step 56, a clearance C having a predetermined dimension is disposed between the metal shell 50 and the insulator 10.

Figure 2A:
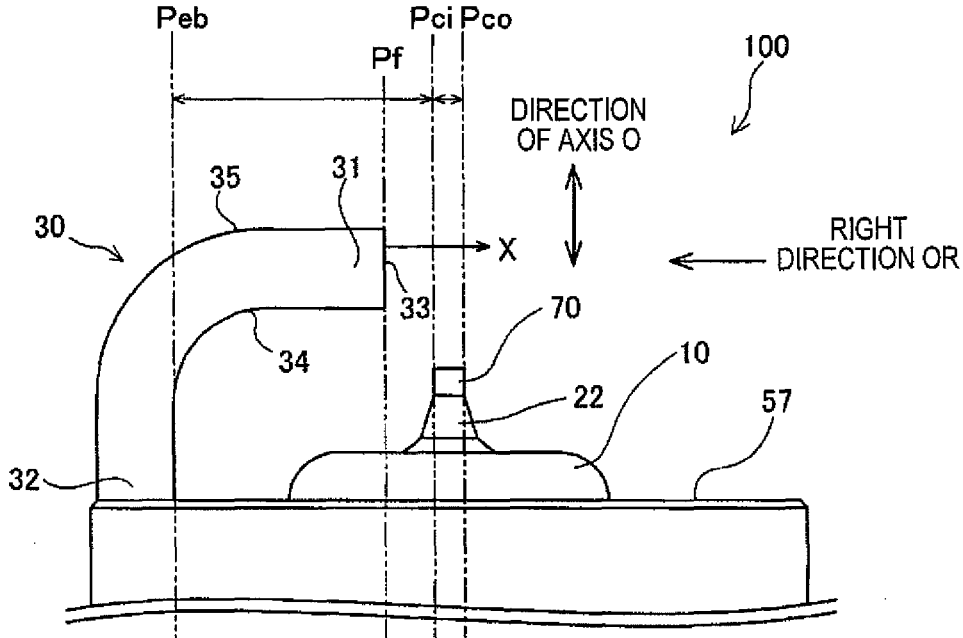
FIG. 2(*a*) is an enlarged, side view of the vicinity of a leading end portion 22 of a center electrode 20 of the spark plug 100.
Figure 2B:
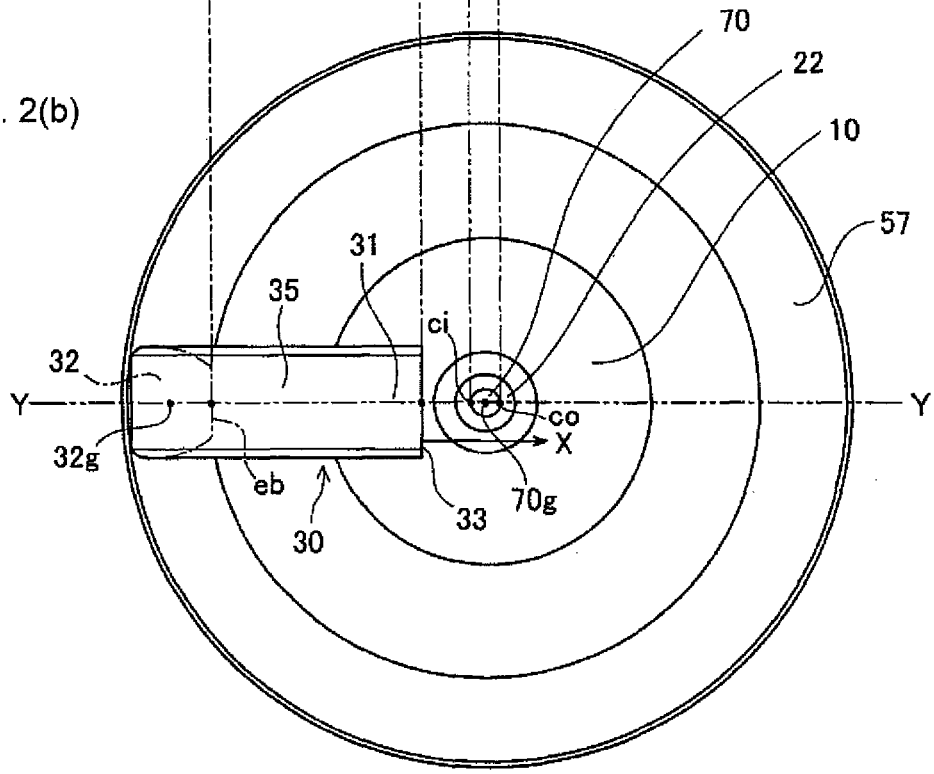
Figure 3:
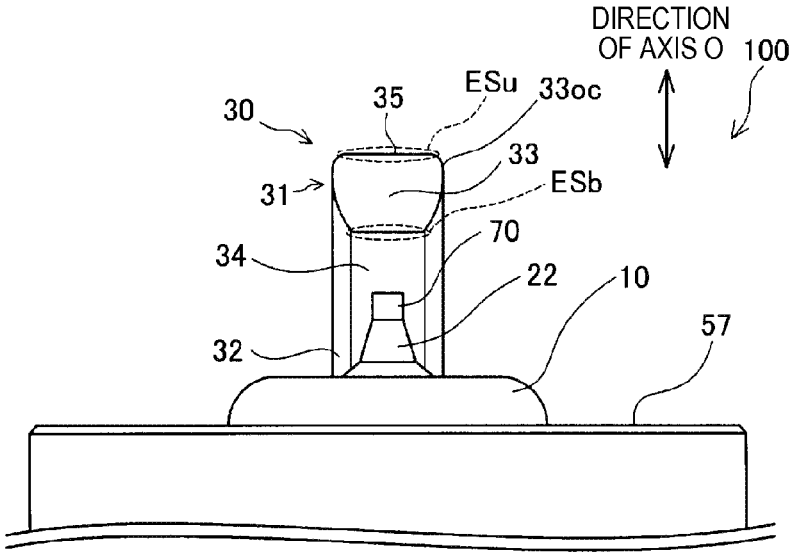
FIG. 3 is an expanded figure of the vicinity of the leading end portion 22 of the center electrode 20 of the spark plug 100.

FIGS. 2(*a*), 2(*b*) and 3 are expanded figures of the vicinity of the leading end portion 22 of the center electrode 20 of the spark plug 100. FIG. 2(*a*) shows the leading end portion 22 of the center electrode 20 in such a manner that the leading end side of the spark plug 100 is in the upper side. FIG. 2(*b*) shows a state where the leading end portion 22 of the center electrode 20 is viewed in the direction of the axis O of the spark plug 100. FIG. 3 is an expanded figure of the vicinity of the leading end portion 22 of the center electrode 20 of the spark plug 100 as viewed in the right direction OR in FIG. 2(*a*).

As shown in FIGS. 2(*a*), 2(*b*) and 3, in the ground electrode 30, the cross section along its longitudinal direction has a substantially rectangular shape, and an end surface 33 having the same shape as the cross section is provided in the leading end portion 31. The end surface 33 may have a shape which is different from the longitudinal cross section of the ground electrode 30. As shown in FIG. 2(*a*), the ground electrode 30 is curved toward the side of the leading end portion 22 of the center electrode 20 so that the direction of the normal X of the end surface 33 is perpendicular to that of the axis O. Moreover, the ground electrode 30 includes an inner side surface 34 on the side surface which is the inside of the curve, and an outer side surface 35 on the side surface which is the outside.

As shown in FIG. 2(*b*), the end surface 33 of the ground electrode 30 is formed so that the direction of the normal X is parallel to the direction (the lateral direction in FIG. 2(*b*)) of a connecting line Y which connects the central point 32*g* of the base end portion 32 of the ground electrode 30, to the central point 70*g* of the center electrode tip 70 formed to the leading end portion 22 of the center electrode 20. The end surface 33 is formed so as to be positioned between the base end portion 32 of the ground electrode 30 and the center electrode tip 70 formed to the leading end portion 22 of the center electrode 20 or on the center electrode tip 70, when viewed in the direction of the axis O (FIG. 2(*b*)).

The position of the end surface 33 in the direction of the connecting line Y will be described more specifically. FIGS. 2(*a*) and 2(*b*) show the following positions in the direction of the connecting line Y:

(1) Position Pf: the position of the end surface 33 of the ground electrode 30;

(2) Position Peb: the position of an end edge eb of the base end portion 32 of the ground electrode 30 on the side of the center electrode 20;

(3) Position Pci: the position of an end point ci which, in the center electrode tip 70, is closest to the ground electrode 30; and (4) Position Pco: the position of an end point co which, in the center electrode tip 70, is farthest from the ground electrode 30.

At this time, the ground electrode 30 is formed so that the position Pf of the end surface 33 is between the position Peb of the ground electrode 30 and the position Pci of the center electrode tip 70. Alternatively, the ground electrode 30 may be formed so as to be between the position Pci of the center electrode tip 70 and the position Pco.

A conventional ground electrode is formed so that, in order that the inner side surface is opposed to the leading end portion 22 of the center electrode 20 in the direction of the axis O, the leading end portion extends beyond the position Pco of the center electrode tip 70 in the direction of the connecting line Y. In the ground electrode 30 of the embodiment, by contrast, the position Pf of the end surface 33 of the ground electrode 30 is set as described above, and hence the length from the base end portion 32 of the ground electrode 30 to the leading end portion 31 can be shortened. Even in the case where the spark plug 100 is used in a high-pressure environment, such as a high-compression and highly supercharged engine, therefore, the temperature rise of the leading end portion 31 of the ground electrode 30 can be suppressed.

As shown in FIG. 3, the end surface 33 of the ground electrode 30 includes, in an outer peripheral portion 33*oc*, an upper end edge ESu which is formed as a line of intersection with the outer side surface 35 and a lower end edge ESb which is formed as a line of intersection with the inner side surface 34. The upper end edge ESu and the lower end edge ESb extend in a direction perpendicular to the direction of the axis O. The shapes of the upper end edge ESu and the lower end edge ESb will be described later in detail with reference to FIG. 4.

Figure 4:
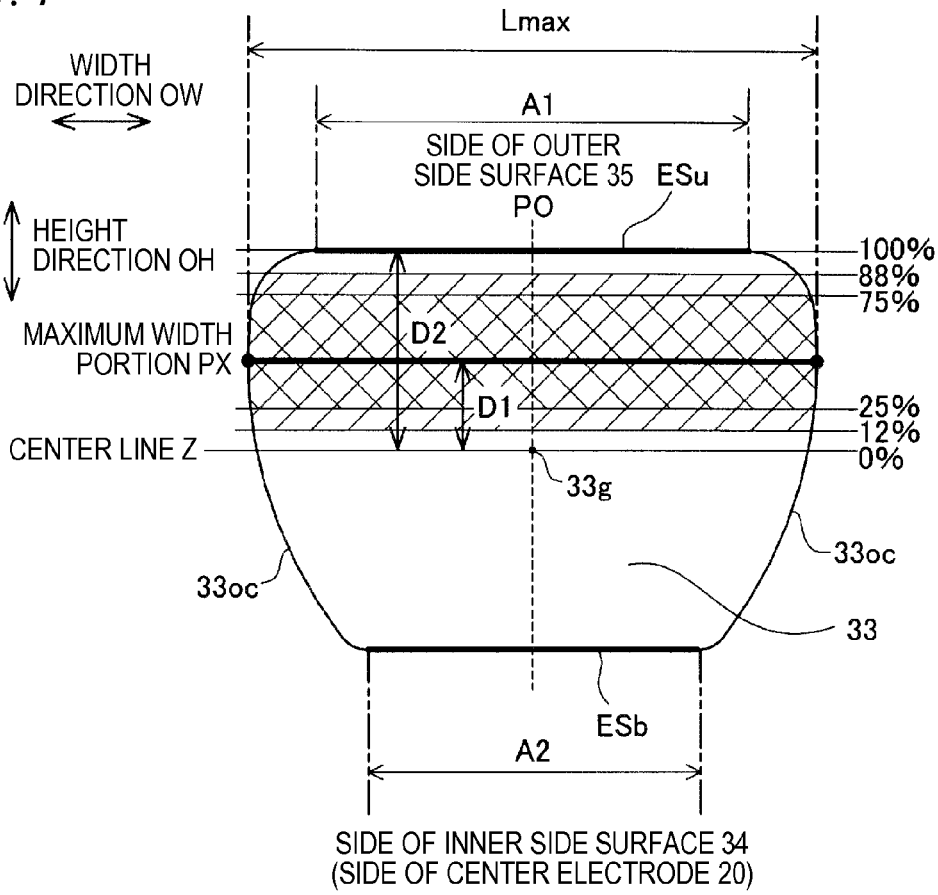
FIG. 4 is a diagram illustrating the shape of an end surface 33 of a ground electrode 30.

FIG. 4 is a diagram illustrating the shape of the end surface 33 of the ground electrode 30. FIG. 4 shows a state where the end surface 33 of the ground electrode 30 is viewed in the direction of its normal X. Here, the direction in which the upper end edge ESu and the lower end edge ESb extend is referred to as the width direction OW (the lateral direction in FIG. 4) of the end surface 33, and the direction which is perpendicular to the upper end edge ESu and the lower end edge ESb is referred to as the height direction OH (the vertical direction in FIG. 4) of the end surface 33. In the end surface 33, the direction of the normal X, the width direction OW, and the height direction OH are perpendicular to one another. Hereinafter, the width of the end surface 33 in the width direction OW is referred to as the width L, and the distance from the center line Z of the end surface 33 in the height direction OH is referred to as the distance D. Here, the center line Z is the line which passes through the central point 33*g* of the end surface 33, and which is parallel to the width direction OW. The central point 33*g* is the point which is located in the middle of the end surface 33 in the width direction OW and the height direction OH.

The end surface 33 has a shape which is curved so that the width L of the end surface 33 is increased at the outer peripheral portion 33*oc* between the upper end edge ESu and the lower end edge ESb. Furthermore, the end surface 33 has a shape that is line-symmetric about a line PO which passes through the central point 33*g* of the end surface 33, and which is parallel to the height direction OH. In the end surface 33, a portion in which the width L is maximum is referred to as the maximum width portion PX. The maximum width portion PX is formed at a position where the distance D1 from the center line Z in the height direction OH is 12% to 88% of the distance D2 which is from the center line Z to the upper end edge ESu (D1/D2=0.12 to 0.88), more preferably 25% to 75% (D1/D2=0.25 to 0.75). In other words, in the end surface 33, the maximum width portion PX is formed only at a position which is 12% to 88%, more preferably 25% to 75% from the center line Z toward the upper end edge ESu, in the direction from the lower end edge ESb toward the upper end edge ESu. Furthermore, the end surface 33 has a shape in which, the more away from the maximum width portion PX in the directions toward the lower end edge ESb and toward the upper end edge ESu, respectively, the more reduced the width L is.

The length of the upper end edge ESu is indicated by A1, the length of the lower end edge ESb is indicated by A2, and the width of the maximum width portion PX is indicated by the width Lmax. The length A1 of the upper end edge ESu is longer than the length A2 of the lower end edge ESb and shorter than the width Lmax of the maximum width portion PX (A2<A1<Lmax). The width Lmax of the maximum width portion PX is configured so as to be equal to or larger than 1.5 mm and equal to or smaller than 2.2 mm (1.5 mm≤Lmax≤2.2 mm).

Figure 5:
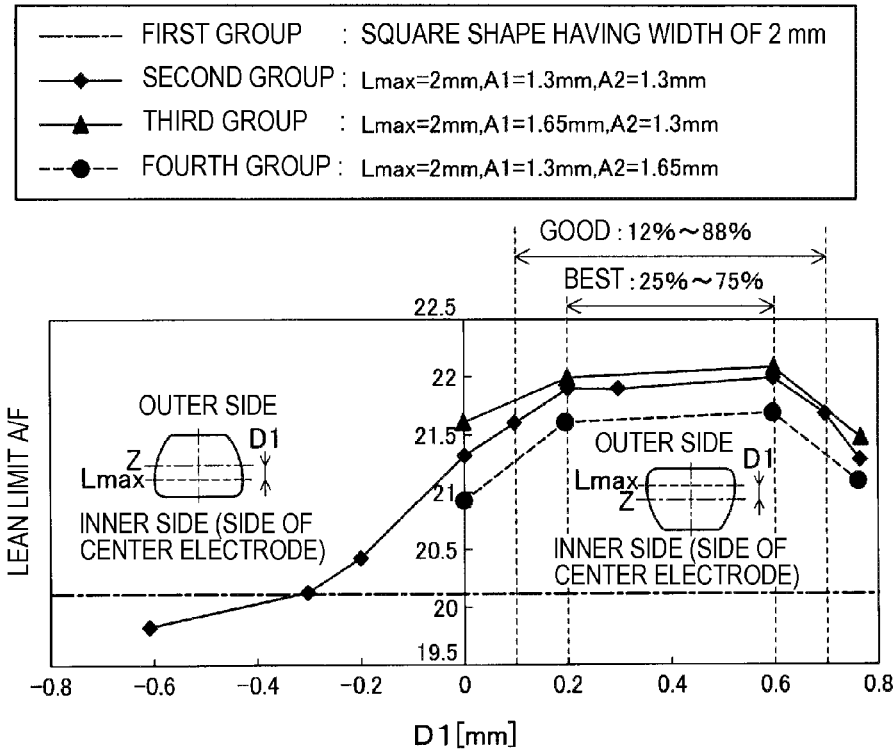
FIG. 5 is a view exemplarily showing results of an ignitability evaluation test related to the position of a maximum width portion PX.

FIG. 5 is a view exemplarily showing results of an ignitability evaluation test related to the position of the maximum width portion PX. In the ignitability evaluation test, an evaluation was conducted by the lean limit method in which 18 kinds of spark plugs having different sectional shapes of the ground electrode 30 were attached to a 1600 cc four-cylinder DOHC gasoline engine. In all of the used spark plugs, the length of the end surface 33 of the ground electrode 30 in the height direction OH is 1.6 mm (D2=0.8 mm), and the width L in the width direction OW is 2.0 mm (Lmax=2.0 mm). Meanwhile, the length A1 of the upper end edge ESu and the length A2 of the lower end edge ESb have the following four combinations:

(1) First group: A1=2.0 mm and A2=2.0 mm (square shape);

(2) Second group: A1=1.3 mm and A2=1.3 mm;

(3) Third group: A1=1.65 mm and A2=1.3 mm; and (4) Fourth group: A1=1.3 mm and A2=1.65 mm.

In the third and fourth groups, the distance D1 of the maximum width portion PX from the center line Z in the height direction OH was set to four kinds of D1=0 mm, 0.2 mm, 0.6 mm, and 0.8 mm. In the second group, 10 kinds were set which includes D1=−0.6 mm, −0.3 mm, −0.2 mm, 0.1 mm, 0.3 mm, and 0.7 mm in addition to the four kinds described above.

From results of the evaluation test, it has been found that, in the second group, the lean limit A/F in the case where D1 is positive (D1=0.1 mm, 0.2 mm, 0.3 mm, 0.6 mm, 0.7 mm, and 0.8 mm, >0) is higher than that in the case where D1 is negative (D1=−0.6 mm, −0.3 mm, and −0.2 mm, <0). Namely, it has been found that the lean limit A/F when the maximum width portion PX is between the center line Z and the upper end edge ESu is higher than that when the portion is between the center line Z and the lower end edge ESb. It is presumed that this is caused by a phenomenon that the flow of the air-fuel mixture can be rectified by forming the maximum width portion PX between the center line Z and the upper end edge ESu.

It has been found that, in any of the second to fourth groups, the lean limit A/F is further improved when D1 is from 0.1 mm to 0.7 mm, i.e., when D1 is 12% to 88% of D2 (D1/D2=0.12 to 0.88). Furthermore, it has been found also that the lean limit A/F is particularly improved when D1 is from 0.2 mm to 0.6 mm, i.e., when D1 is 25% to 75% (D1/D2=0.25 to 0.75).

Meanwhile, when the first group is compared with the second to fourth groups, it has been found that, when A1 and A2 are smaller than Lmax, the lean limit A/F is improved. When the second to fourth groups are compared with each other, it has been found that, when A1 is larger than A2, the lean limit A/F is further improved. Therefore, it is most preferable that A1 is larger than A2 and smaller than Lmax.

Figure 6:
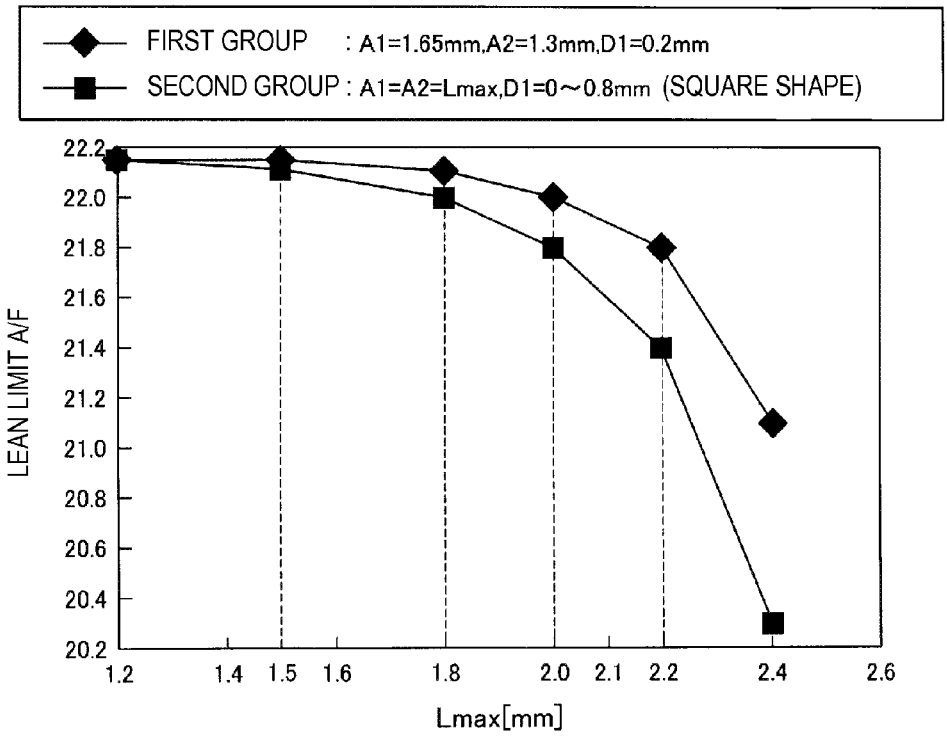
FIG. 6 is a view exemplarily showing results of an ignitability evaluation test related to the width Lmax of the maximum width portion PX.

FIG. 6 is a view exemplarily showing results of the ignitability evaluation test related to the width Lmax of the maximum width portion PX. In the ignitability evaluation test, an evaluation was conducted by the lean limit method in which 12 kinds of spark plugs having different widths Lmax of the maximum width portion PX were attached to a 1600 cc four-cylinder DOHC gasoline engine. In all of the used spark plugs, the length of the end surface 33 of the ground electrode 30 in the height direction OH is 1.6 mm (D2=0.8 mm), and the length A1 of the upper end edge ESu, the length A2 of the lower end edge ESb, and the distance D1 of the maximum width portion PX from the center line Z in the height direction OH have the following two combinations:

(1) First group: A1=1.65 mm, A2=1.3 mm, and D1=0.2 mm; and (2) Second group: A1=A2=Lmax and D1=0 to 0.8 mm (square shape).

(3) In each of the groups, the width Lmax of the maximum width portion PX was set to six kinds of 1.2 mm, 1.5 mm, 1.8 mm, 2.0 mm, 2.2 mm, and 2.4 mm.

From results of the evaluation test, it is known that, in both the first and second groups, the lean limit A/F is largely reduced when the width Lmax of the maximum width portion PX is larger than 2.2 mm. By contrast, it is known that the lean limit A/F in the case where the width Lmax of the maximum width portion PX is 1.5 mm to 2.2 mm is higher than that in the case where the width Lmax is larger than 2.2 mm. It is presumed that this is caused by a phenomenon that, when the width Lmax of the maximum width portion PX, i.e., the width of the ground electrode 30 is large, the flow of the air-fuel mixture cannot be well rectified to the ignition point. Furthermore, it is known that, when the width Lmax of the maximum width portion PX is 1.5 mm to 2.2 mm, the lean limit A/F of the first group is higher than that of the second group. From this, it is known that, when the width Lmax of the maximum width portion PX is set within the range of 1.5 mm to 2.2 mm, the lean limit A/F is remarkably improved as compared with a spark plug having a square shape. Moreover, it is known that, when the width Lmax of the maximum width portion PX is set within the range of 1.8 mm to 2.2 mm, the lean limit A/F is particularly remarkably improved as compared with a spark plug having a square shape.

According to the above-described spark plug, the flow of the air-fuel mixture, particularly, that of the air-fuel mixture which flows from the base end portion 32 of the ground electrode 30 toward the leading end portion 22 of the center electrode 20 (from the left to the right in FIGS. 2(*a*) and 2(*b*)) can be rectified, and hence the ignitability of the ground electrode can be improved. According to the spark plug of the embodiment, furthermore, the length of the ground electrode 30 is shortened, and therefore the temperature rise of the leading end portion 31 of the ground electrode 30 can be suppressed even in a high-pressure environment.

Figure 7A:
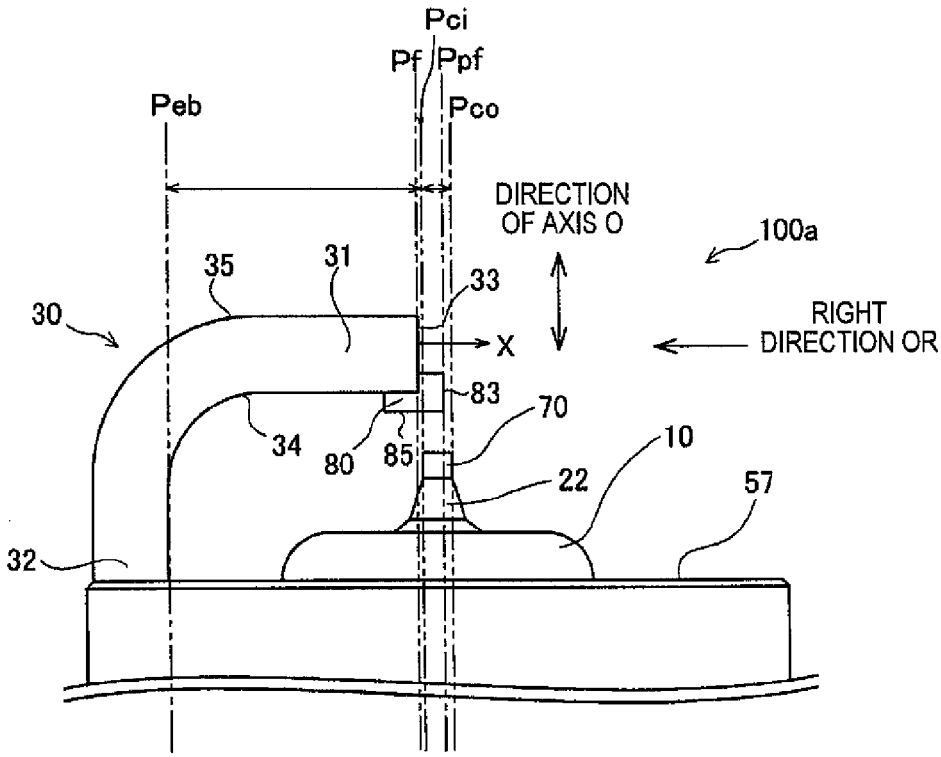
FIGS. 7(*a*) and 7(*b*) are enlarged side views of the vicinity of the leading end portion 22 of the center electrode 20 of a spark plug 100*a* of a second embodiment.
Figure 7B:
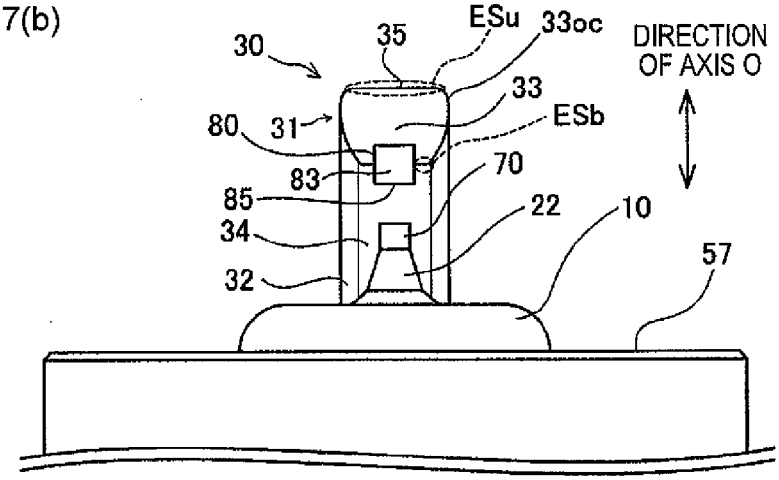

B. Second Embodiment (4) FIGS. 7(*a*) and 7(*b*) are enlarged side views of the vicinity of the leading end portion 22 of the center electrode 20 of a spark plug 100*a* of a second embodiment. FIG. 7(*a*) corresponds to FIG. 2(*a*) in the first embodiment, and FIG. 7(*b*) corresponds to FIG. 3 in the first embodiment. The second embodiment is different from the first embodiment in that an outer electrode tip 80 is attached to the leading end portion 31 of the ground electrode 30.

The outer electrode tip 80 has a columnar outer shape having a substantially rectangular section. The outer electrode tip 80 is partly embedded by resistance welding into the leading end portion 31 of the ground electrode 30. Therefore, the outer electrode tip 80 projects from the end surface 33 of the ground electrode 30 in the direction (the right direction in FIG. 7(*a*)) of the normal X, in a state where the normal direction of an end surface 83 of the tip is parallel to the direction of the normal X of the end surface 33 of the ground electrode 30. Moreover, the outer electrode tip 80 projects from the inner side surface 34 of the ground electrode 30 toward the leading end portion 22 of the center electrode 20, in a state where a side surface 85 of the tip is directed toward the leading end portion 22 of the center electrode 20 (the lower side in FIG. 7(*a*)). Similarly with the center electrode tip 70, the outer electrode tip 80 is made of a high melting noble metal. The configuration where the outer electrode tip 80 is attached to the leading end portion 31 of the ground electrode 30 can further improve the spark consumption resistance.

Figure 8:
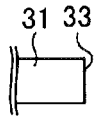
FIG. 8 is a view exemplarily showing results of an ignitability evaluation test related to the attachment position of an outer electrode tip 80.
Figure 8:
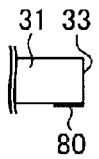
Figure 8:
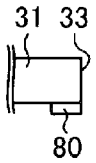
Figure 8:
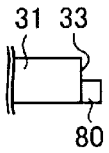
Figure 8:
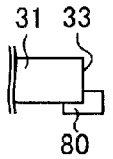
Figure 8:
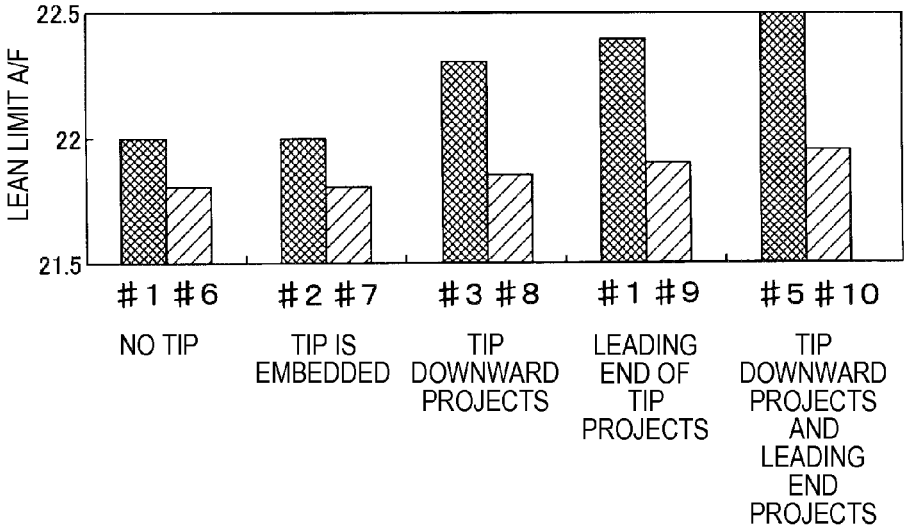

FIG. 8 is a view exemplarily showing results of an ignitability evaluation test related to the attachment position of the outer electrode tip 80. In the ignitability evaluation test, an evaluation was conducted by the lean limit method in which eight kinds of spark plugs in which the attachment positions of their outer electrode tips 80 are different from one another, and two kinds of spark plugs including no outer electrode tip 80 were attached to a 1600 cc four-cylinder DOHC gasoline engine. In all of the prepared spark plugs, the length of the end surface 33 of the ground electrode 30 in the height direction OH is 1.6 mm (D2=0.8 mm), the width Lmax of the maximum width portion PX is 2 mm, and the length A1 of the upper end edge ESu and the length A2 of the lower end edge ESb have the following two combinations:

(1) First group: A1=1.65 mm and A2=1.3 mm; and (2) Second group: A1=A2=Lmax (square shape).

Five samples #1 to #5 in the first group, and five samples #6 to #10 in the second group are configured in the following manners:

(1) Sample #1 and sample #6: spark plugs including no outer electrode tip 80;

(2) Sample #2 and sample #7: spark plugs in which the outer electrode tip 80 is embedded into the leading end portion 31 of the ground electrode 30, and does not project both in the direction of the normal X and toward the leading end portion 22 of the center electrode 20;

(3) Sample #3 and sample #8: spark plugs in which the outer electrode tip 80 projects only toward the leading end portion 22 of the center electrode 20, and does not project in the direction of the normal X;

(4) Sample #4 and sample #9: spark plugs in which the outer electrode tip 80 projects only in the direction of the normal X, and does not project toward the leading end portion 22 of the center electrode 20; and (5) Sample #5 and sample #10: spark plugs in which the outer electrode tip 80 projects both in the direction of the normal X and toward the leading end portion 22 of the center electrode 20.

The diameters ϕ of the center electrode tips 70 of Samples #1 to #10 are 0.55 mm. The outer electrode tips 80 of Samples #2 to #5 and #7 to #10 have a square sectional shape in which one edge is 0.7 mm. In Samples #3, #5, #8, and #10, the side surface 85 of the outer electrode tip 80 projects 0.3 mm from the inner side surface 34 of the ground electrode 30 toward the leading end portion 22 of the center electrode 20. In Samples #4, #5, #9, and #10, the end surface 83 of the outer electrode tip 80 projects 0.65 mm from the end surface 33 of the ground electrode 30 in the direction of the normal X.

From results of the evaluation test on the first group, it has been found that the ignitability of the ground electrode is further improved when the outer electrode tip 80 is attached to the spark plug 100 (FIGS. 2(*a*) and 2(*b*)) described in the first embodiment, so as to project from the ground electrode 30. It has been found that the ignitability of the ground electrode is further improved, for example, in the case where, as in Samples #4 and #5, the outer electrode tip 80 is attached to the spark plug 100 so as to project from the end surface 33 of the ground electrode 30 in the direction of the normal X, and the case where, as in Samples #3 and #5, the outer electrode tip 80 is attached so as to project from the inner side surface 34 of the ground electrode 30 toward the leading end portion 22 of the center electrode 20. Furthermore, it has been found that the ignitability of the ground electrode is particularly improved when, as in Sample #5, the outer electrode tip 80 is attached to the spark plug 100 so as to project from the end surface 33 of the ground electrode 30 in the direction of the normal X, and from the inner side surface 34 of the ground electrode 30 toward the leading end portion 22 of the center electrode 20.

It is presumed that the reason why the ignitability of the ground electrode is further improved when the outer electrode tip 80 is attached to the spark plug 100 so as to project from the ground electrode 30 is that the air-fuel mixture gas which has been rectified by the shape of the end surface 33 of the ground electrode 30 is guided to the ignition point while flowing along the outer electrode tip 80.

When comparing the results of the evaluation tests on the first and second groups, it has been found that, in the spark plug 100 (FIGS. 2(*a*) and 2(*b*)) which has been described in the first embodiment, the degree of improvement of the ignitability of the ground electrode in the case where the outer electrode tip 80 is attached so as to project from the ground electrode 30 is larger than that in the case of the spark plug having a square shape.

C. Third Embodiment

Figure 9A:
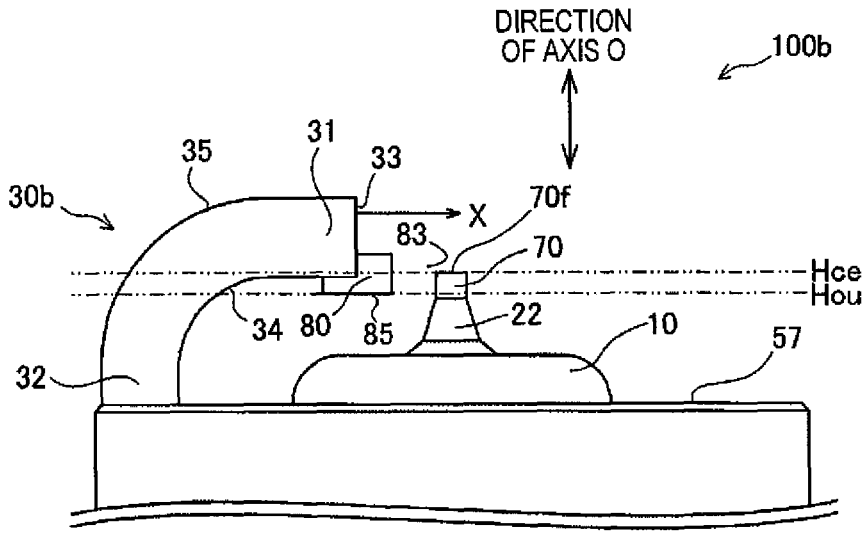
FIGS. 9(*a*) and 9(*b*) are enlarged side views of the vicinity of the leading end portion 22 of the center electrode 20 of a spark plug 100*b* of a third embodiment.
Figure 9B:
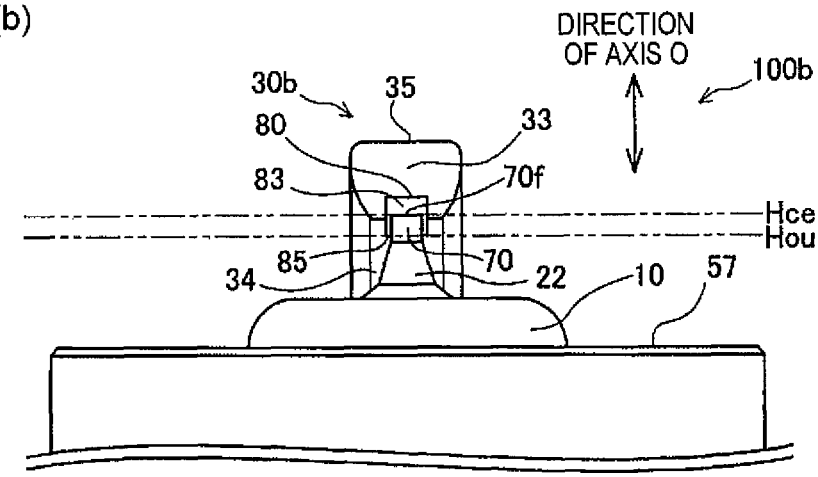

FIGS. 9(*a*) and 9(*b*) are enlarged side views of the vicinity of the leading end portion 22 of the center electrode 20 of a spark plug 100*b* of a third embodiment. FIG. 9(*a*) corresponds to FIG. 2(*a*) in the first embodiment, and FIG. 9(*b*) corresponds to FIG. 3 in the first embodiment. The third embodiment is different from the first embodiment in that the ground electrode 30 has a different shape, and that, similarly with the second embodiment, the outer electrode tip 80 is attached to the leading end portion 31 of the ground electrode 30. The shape of the outer electrode tip 80 and the attachment position in the ground electrode 30 are identical with those in the second embodiment, and therefore their description will be omitted.

Similarly with the ground electrode 30 in the first embodiment, a ground electrode 30*b* in the third embodiment is curved toward the side of the leading end portion 22 of the center electrode 20 so that the direction of the normal line X of the end surface 33 is perpendicular to that of the axis O (the vertical direction in FIGS. 9(*a*) and 9(*b*)). On the other hand, the ground electrode 30*b* is formed at a position where the leading end portion 31 of the ground electrode 30*b* is located closer to the leading end surface 57 of the metal shell 50 as compared with the ground electrode 30 of the first embodiment. Specifically, the ground electrode 30*b* is formed so that the position Hou of the side surface 85 of the outer electrode tip 80 is closer to the leading end surface 57 of the metal shell 50 in the direction of the axis O than the position Hce of the end surface 70*f* of the center electrode tip 70.

In the spark plug 100*b*, the end surface 83 of the outer electrode tip 80 is opposed to a side surface of the center electrode tip 70, and therefore a spark gap is formed in a direction (the lateral direction in FIGS. 9(*a*) and 9(*b*)) which is approximately perpendicular to the direction of the axis O, so that lateral discharge is produced. The shape of the end surface 33 of the ground electrode 30*b* is similar to the shape (FIG. 4) of the end surface 33 of the ground electrode 30, and therefore its description will be omitted. Also in the configuration of the spark plug 100*b* of the third embodiment, when the spark plug is used in a gasoline engine, the flow of the air-fuel mixture, particularly, that of the air-fuel mixture which flows in the direction from the base end portion 32 of the ground electrode 30 toward the leading end portion 22 of the center electrode 20 (from the left to the right in FIG. 9(*a*)) can be rectified, and hence the ignitability of the ground electrode can be improved.

D. Modifications

The invention is not limited to the above-described embodiments and embodiment modes, and may be implemented in various manners without departing from the spirit of the invention. For example, the following modifications may be performed.

D-1. Modifications 1 and 2

Figure 10:
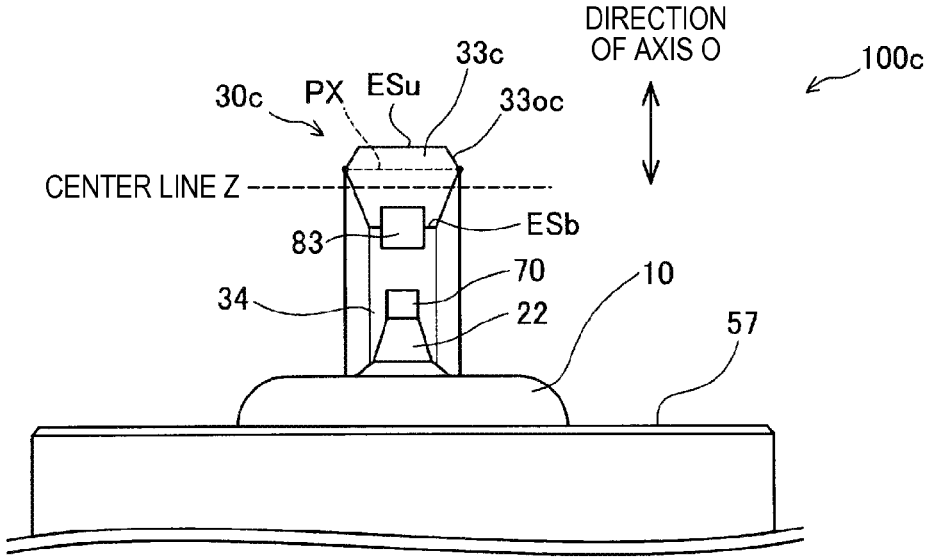
FIG. 10 is an expanded figure of the vicinity of the leading end portion 22 of the center electrode 20 of a spark plug of Modification 1.
Figure 11:
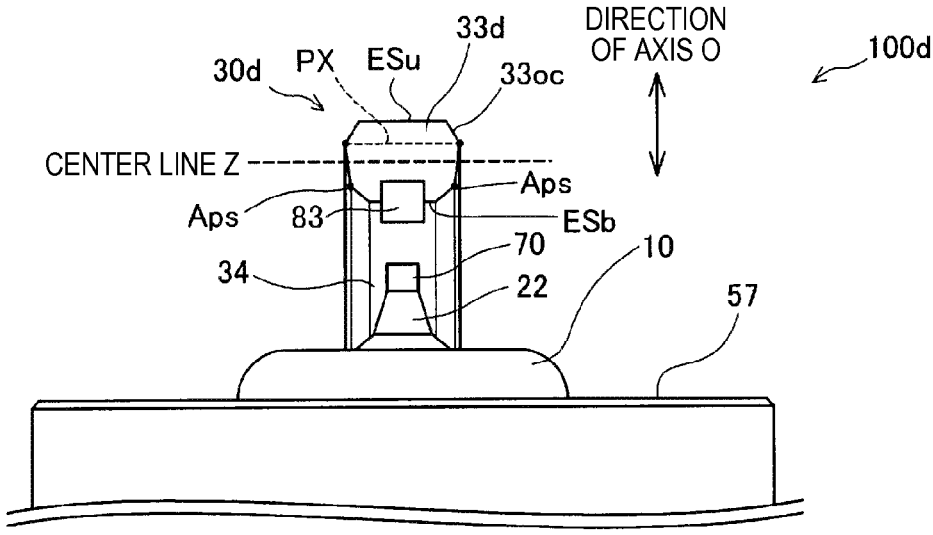
FIG. 11 is an expanded figure of the vicinity of the leading end portion 22 of the center electrode 20 of a spark plug of Modification 2.

FIG. 10 is an expanded figure of the vicinity of the leading end portion 22 of the center electrode 20 of a spark plug of Modification 1. FIG. 11 is an expanded figure of the vicinity of the leading end portion 22 of the center electrode 20 of a spark plug of Modification 2. FIGS. 10 and 11 correspond to FIG. 3 in the first embodiment. In the first to third embodiments, it has been described that, as shown in FIG. 4, the end surface 33 of the ground electrode 30 has the shape which is curved so that the width L of the end surface 33 is increased, in the outer peripheral portion 33*oc* between the upper end edge ESu and the lower end edge ESb. However, the outer peripheral portion 33*oc* between the upper end edge ESu and the lower end edge ESb does not necessarily need to be configured only by curved lines. As in a spark plug 100*c* shown in FIG. 10, in an end surface 33*c* of a ground electrode 30*c*, for example, an outer peripheral portion 33*oc* between the maximum width portion PX and the upper end edge ESu, and an outer peripheral portion 33*oc* between the maximum width portion PX and the lower end edge ESb may be linearly formed. Also in the configuration of the spark plug 100*c*, the flow of the air-fuel mixture can be rectified, and hence the ignitability of the ground electrode can be improved.

As in a spark plug 100*d* shown in FIG. 11, an end surface 33*d* of a ground electrode 30*d* may have a polygonal shape in which a plurality of edge portions Aps are formed in the outer peripheral portion 33*oc*. Also in the configuration of the spark plug 100*c*, the flow of the air-fuel mixture can be rectified, and hence the ignitability of the ground electrode can be improved.

D-2: Modifications 3 and 4

Figure 12:
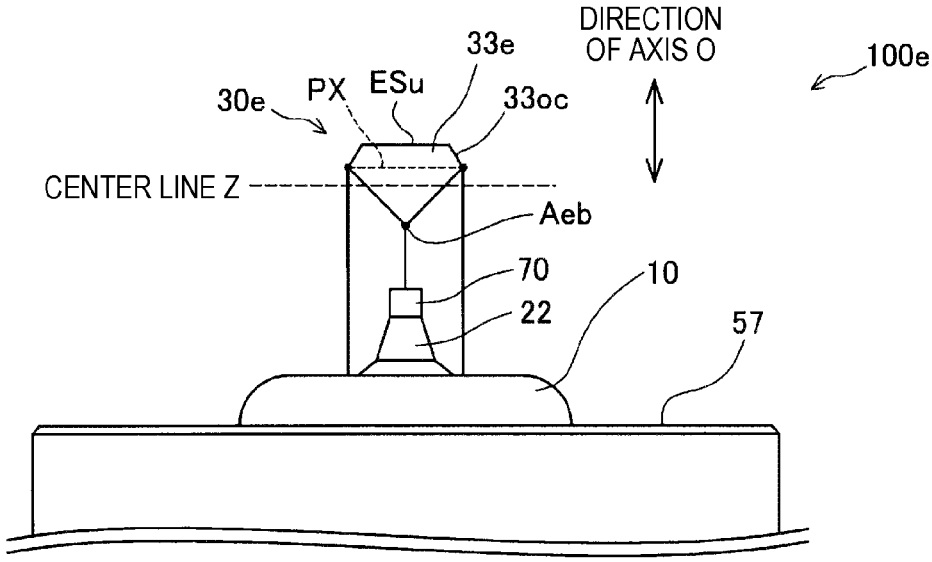
FIG. 12 is an expanded figure of the vicinity of the leading end portion 22 of the center electrode 20 of a spark plug of Modification 3.
Figure 13:
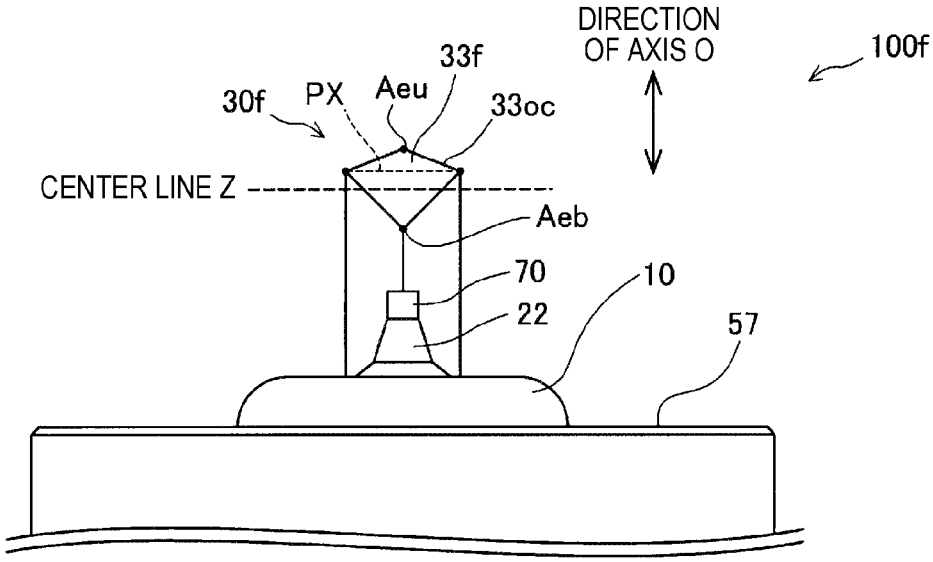
FIG. 13 is an expanded figure of the vicinity of the leading end portion 22 of the center electrode 20 of a spark plug of Modification 4.

FIG. 12 is an expanded figure of the vicinity of the leading end portion 22 of the center electrode 20 of a spark plug of Modification 3. FIG. 13 is an expanded figure of the vicinity of the leading end portion 22 of the center electrode 20 of a spark plug of Modification 4. FIGS. 12 and 13 correspond to FIG. 3 in the first embodiment. In the first to third embodiments, it has been described that, as shown in FIG. 3, the end surface 33 of the ground electrode 30 includes the upper end edge ESu which is formed as a line of intersection with the outer side surface 35, and the lower end edge ESb which is formed as a line of intersection with the inner side surface 34. However, the ground electrode 30 does not necessarily need to include the inner side surface 34 and the outer side surface 35. Moreover, the end surface 33 of the ground electrode 30 does not necessarily need to include the upper end edge ESu and the lower end edge ESb. As in a spark plug 100*e* shown in FIG. 12, for example, an end surface 33*e* of a ground electrode 30*e* may not include a lower end edge ESbe, and an inner edge portion Aeb may be formed. Also in the configuration of the spark plug 100*e*, the flow of the air-fuel mixture can be rectified, and hence the ignitability of the ground electrode can be improved.

As in a spark plug 100*f* shown in FIG. 13, an end surface 33*f* of a ground electrode 30*f* may not include a lower end edge ESbe and the upper end edge ESu, and the inner edge portion Aeb and an outer edge portion Aeu may be formed. Also in the configuration of the spark plug 100*f*, the flow of the air-fuel mixture can be rectified, and hence the ignitability of the ground electrode can be improved.

D-3. Modification 5

Figure 14:
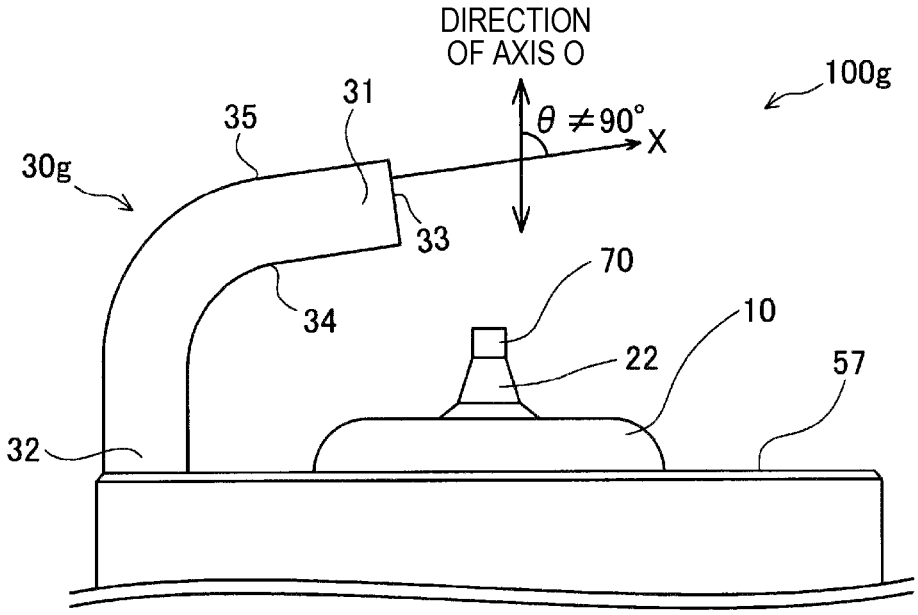
FIG. 14 is an expanded figure of the vicinity of the leading end portion 22 of the center electrode 20 of a spark plug of Modification 5.

FIG. 14 is an expanded figure of the vicinity of the leading end portion 22 of the center electrode 20 of a spark plug of Modification 5. FIG. 14 corresponds to FIG. 2(*a*) in the first embodiment. In the first to third embodiments, it has been described that, as shown in FIG. 2(*a*), in the ground electrode 30, the direction of the normal X of the end surface 33 is perpendicular to that of the axis O. However, as shown in FIG. 14, the ground electrode 30 does not necessarily need to be configured so that the direction of the normal X of the end surface 33 is perpendicular to that of the axis O. Also in the configuration of the spark plug 100*g*, when the end surface 33 of a ground electrode 30*g* has a shape such as shown in FIG. 4, the flow of the air-fuel mixture can be rectified, and hence the ignitability of the ground electrode can be improved.

D-4. Modification 6

Figure 15A:
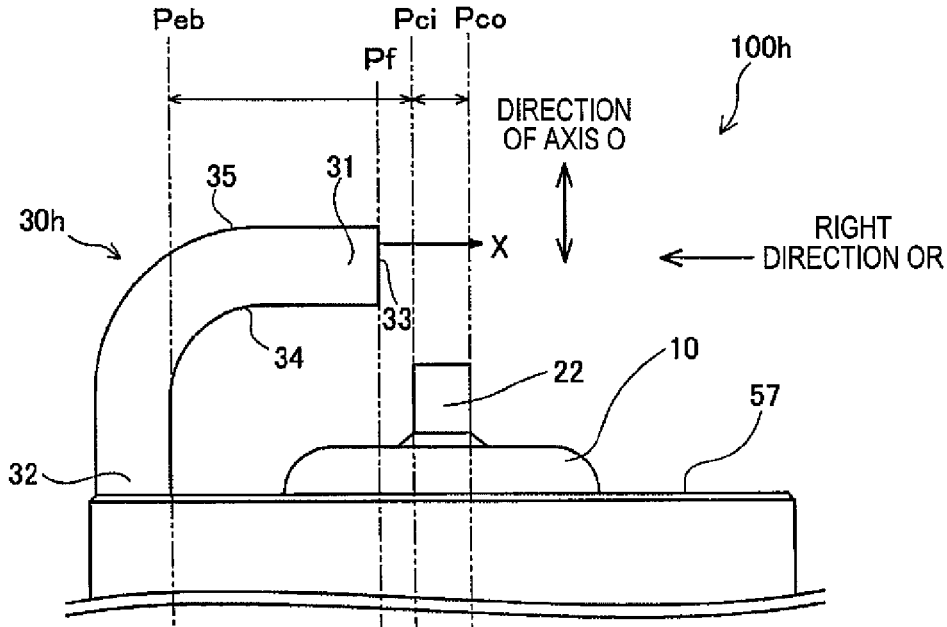
FIGS. 15(*a*) and 15(*b*) are enlarged side views of the vicinity of the leading end portion 22 of the center electrode 20 of a spark plug of Modification 6.
Figure 15B:
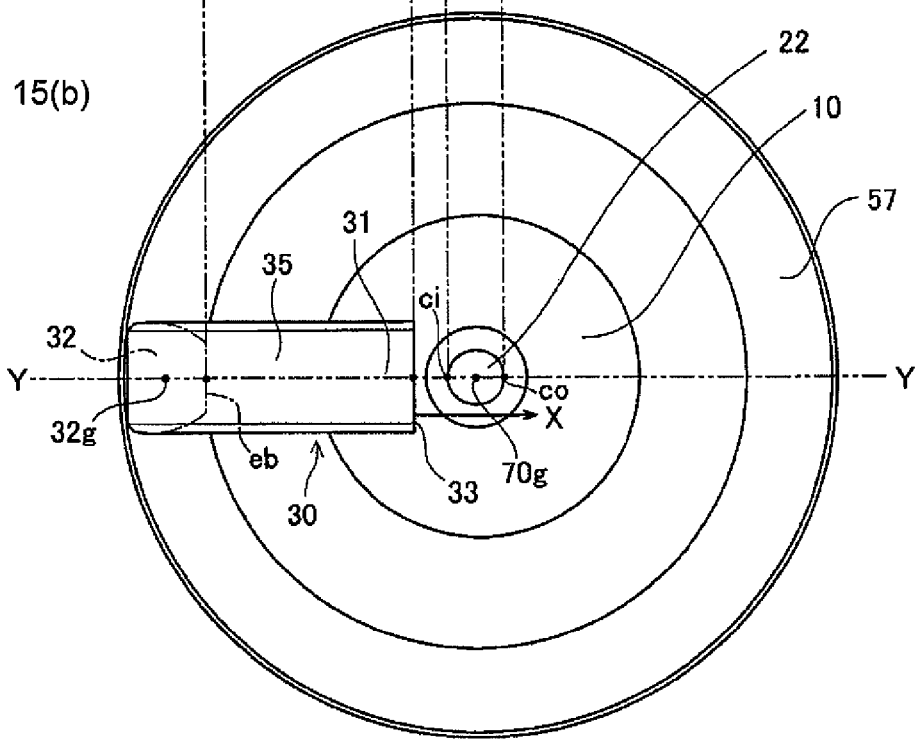

FIGS. 15(*a*) and 15(*b*) are enlarged side views of the vicinity of the leading end portion 22 of the center electrode 20 of a spark plug of Modification 6. FIGS. 15(*a*) and 15(*b*) correspond to FIGS. 2(*a*) and 2(*b*) in the first embodiment. In the first to third embodiments, it has been described that the center electrode 20 of the spark plug 100 includes the center electrode tip 70 at the leading end portion 22, and the end point ci and end point co shown in FIG. 2(*b*) constitute a part of the center electrode tip 70. Alternatively, as in a spark plug 100*h* shown in FIGS. 15(*a*) and 15(*b*), the leading end portion 22 of the center electrode 20 does not include the center electrode tip 70, and the position of the end surface 33 of a ground electrode 30*h* may be set while using parts of the leading end portion 22 itself formed by the electrode base member 21 as the end point ci and the end point co.

D-5. Modification 7

The above-described first to third embodiments and Modifications 1 to 6 may be realized by combining them in an arbitrary manner. For example, the spark plug 100*b* (FIGS. 9(*a*) and 9(*b*)) of the third embodiment may be realized even by a configuration in which the leading end portion 31 of the ground electrode 30 does not include the outer electrode tip 80. Moreover, the spark plug 100*e* (FIG. 12) of Modification 3 may be realized also by a configuration in which, as in the spark plug 100*g* (FIG. 16) of Modification 5, the direction of the normal X of the end surface 33 of the ground electrode 30 is not perpendicular to that of the axis O.

DESCRIPTION OF REFERENCE NUMERALS AND SIGNS

3 . . . ceramic resistor
4 . . . seal member
5 . . . gasket
6 . . . cylindrical member
8 . . . sheet packing
9 . . . talc
10 . . . insulator
12 . . . axial hole
13 . . . insulator nose portion
15 . . . step
17 . . . leading end trunk portion
18 . . . rear end trunk portion
19 . . . flange portion
20 . . . center electrode
21 . . . electrode base member
25 . . . core member
30 . . . ground electrode
31 . . . leading end portion
32 . . . base end portion
33 . . . end surface
34 . . . inner side surface
35 . . . outer side surface
40 . . . terminal metal fixture
50 . . . metal shell
51 . . . tool engagement portion
52 . . . attachment screw portion
53 . . . crimping portion
54 . . . seal portion
55 . . . seating surface
56 . . . step
57 . . . leading end surface
58 . . . buckling portion
59 . . . thread neck
70 . . . center electrode tip
80 . . . outer electrode tip
100 . . . spark plug
200 . . . engine head
201 . . . attachment threaded hole
205 . . . opening peripheral edge portion Having described the invention, the following is claimed:

1. A spark plug comprising:

a center electrode which extends in an axial direction;

a cylindrical insulator which is disposed around an outer circumference of the center electrode;

a cylindrical metal shell which is disposed around an outer circumference of the insulator; and a ground electrode having one end connected to the metal shell and which is curved from the one end to another end thereof, and an end surface of the other end being positioned between the one end and the center electrode or on the center electrode, when viewed in the axial direction of the center electrode, wherein the end surface has a maximum width portion which has a maximum width in a direction perpendicular to the axial direction of the center electrode, wherein the maximum width portion of the end surface is formed only at a position where a distance from a center position of the end surface is 12% to 88% of a distance from the center position of the end surface an outer side surface of the ground electrode in a direction directed from an inner side surface of the ground electrode to the outer side surface of the ground electrode, and wherein the more away from the maximum width portion toward the inner side surface and the outer side surface of the ground electrode, respectively, the more reduced the width of the end surface is in the direction perpendicular to the axial direction of the center electrode.

2. The spark plug according to claim 1, wherein the maximum width portion of the end surface is formed only at a position where the distance from the center position of the end surface is 25% to 75% of a distance from the center position of the end surface to the outer side surface in the direction directed from the inner side surface of the ground electrode to the outer side surface of the ground electrode.

3. The spark plug according to claim 1, wherein an outer peripheral portion of the end surface includes a first end edge and a second end edge which linearly extend in the direction perpendicular to the axial direction of the center electrode, wherein the first end edge is a line of intersection of the end surface and the outer side surface, wherein the second end edge is a line of intersection of the end surface and the inner side surface, and wherein a length A1 of the first end edge is longer than a length A2 of the second end edge and shorter than the width of the maximum width portion.

4. The spark plug according to claim 3, wherein, in the end surface, the outer peripheral portion between the first end edge and the second edge has a curved shape.

5. The spark plug according to claim 1, wherein the width of the maximum width portion is equal to or larger than 1.5 mm and equal to smaller than 2.2 mm.

6. The spark plug according to claim 1, wherein the ground electrode is attached so that a noble metal tip projects from the end surface.

* * * * *